US010190341B2

(12) United States Patent
Lee

(10) Patent No.: US 10,190,341 B2
(45) Date of Patent: Jan. 29, 2019

(54) DOOR OUTSIDE HANDLE

(71) Applicant: Hyundai Motor Company, Seoul (KR)

(72) Inventor: Sang Hyun Lee, Jeju-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/374,306

(22) Filed: Dec. 9, 2016

(65) Prior Publication Data

US 2018/0073278 A1 Mar. 15, 2018

(30) Foreign Application Priority Data

Sep. 12, 2016 (KR) ..... 10-2016-0117011

(51) Int. Cl.

| | |
|---|---|
| ***E05B 77/04*** | (2014.01) |
| ***E05B 79/06*** | (2014.01) |
| ***E05B 85/10*** | (2014.01) |
| ***E05B 85/16*** | (2014.01) |
| *E05B 15/04* | (2006.01) |

(52) U.S. Cl.

CPC ..... *E05B 77/04* (2013.01); *E05B 79/06* (2013.01); *E05B 85/10* (2013.01); *E05B 85/16* (2013.01); *E05B 2015/0406* (2013.01); *Y10T 292/57* (2015.04)

(58) Field of Classification Search

CPC ..... E05B 85/16; E05B 85/18; E05B 85/10; E05B 77/04; E05B 77/06; E05B 79/06; E05B 2015/0406; Y10T 292/57; Y10S 292/22

USPC ..... 292/336.3, DIG. 22

See application file for complete search history.

(56) References Cited

U.S. PATENT DOCUMENTS

| | | | | |
|---|---|---|---|---|
| 6,042,159 | A * | 3/2000 | Spitzley | E05B 77/06 16/111.1 |
| 6,695,520 | B1 * | 2/2004 | Sarno | H05K 7/1409 292/64 |
| 8,376,424 | B2 * | 2/2013 | Bejune | E05B 77/04 292/336.3 |
| 8,727,402 | B2 * | 5/2014 | Bejune | E05B 77/04 292/336.3 |
| 2005/0218668 | A1 * | 10/2005 | Sakamoto | E05B 77/04 292/336.3 |
| 2009/0026774 | A1 | 1/2009 | Watanabe et al. | |
| 2010/0088855 | A1 * | 4/2010 | Ruse | E05B 77/06 16/412 |
| 2014/0138962 | A1 | 5/2014 | Nagata et al. | |

(Continued)

FOREIGN PATENT DOCUMENTS

| | | | | |
|---|---|---|---|---|
| DE | 10260900 | A1 * | 7/2004 | E05B 77/04 |
| EP | 1538287 | A1 * | 6/2005 | E05B 77/04 |
| KR | 10-0811714 | B1 | 3/2008 | |

(Continued)

*Primary Examiner* — Christine M Mills

(74) *Attorney, Agent, or Firm* — Morgan, Lewis & Bockius LLP

(57) ABSTRACT

A door outside handle is provided. The door outside handle includes a first base to which a handle lever connected with a handle grip is coupled; a second base which is coupled with a hinge portion of the handle grip and formed to be separated from the first base, and performs pivotal movement toward the inside of a door with respect to the first base when a crash occurs; and a connection member connecting the first base and the second base together and facilitating the pivotal movement of the second base.

5 Claims, 2 Drawing Sheets

(56) References Cited

U.S. PATENT DOCUMENTS

| | | | |
|---|---|---|---|
| 2015/0069764 | A1 | 3/2015 | Kerr, III |
| 2015/0322699 | A1 | 11/2015 | Ilardo et al. |

FOREIGN PATENT DOCUMENTS

| | | | |
|---|---|---|---|
| KR | 10-2011-0032508 | A | 3/2011 |
| KR | 10-2011-0137949 | A | 12/2011 |
| KR | 20160099901 | A | 8/2016 |

* cited by examiner

DOOR OUTSIDE HANDLE

CROSS-REFERENCE(S) TO RELATED APPLICATION

The present application claims priority to Korean Patent Application No. 10-2016-0117011 filed on Sep. 12, 2016, the entire contents of which is incorporated herein for all purposes by this reference.

BACKGROUND

Field of the Invention

The present invention relates to a door outside handle, and more particularly to a door outside handle that can prevent the door from being opened unexpectedly in the event of side-impact vehicle crash.

Description of Related Art

Typically, vehicle doors can be opened in such a way that pulling a grip of a door outside handle (hereinafter, referred to as the "handle grip") causes an engaging portion of a handle grip to pull a projection of the door outside handle (hereinafter, referred to as the "handle lever) so that a handle lever rotates and at the same time a latch is released while a rod or a cable coupled to the handle lever is pulled, thereby opening the door.

However, in the event of a side-impact vehicle crash, a door panel moves into the interior of the vehicle, whereas a door handle no longer moves due to inertia and hence the same result as the case of pulling the handle grip occurs, as a result, there is occurred a problem that the door of the vehicle is opened.

Accordingly, if the door is opened in the event of the side-impact vehicle crash, there is occurred a problem that occupants are thrown out of the vehicle, and hence it is concerned about a risk of further injuries due to opening of the door in addition to injuries caused by the crash.

In the existing vehicle doors, therefore, in order to comply with related laws and regulations, a balance weight for imparting weight counteracting a door opening direction (or rotation direction) of the handle lever is often installed in the handle lever so as to prevent a situation that the handle lever rotates toward a direction of forcing the door to be opened by inertia and hence the door is opened unexpectedly in the event of the side-impact vehicle crash.

In this case, however, as it is a structure in which both the handle lever and a hinge portion provided on the handle grip are fixed to the door panel, there is possibly a phenomenon that the handle grip is lifted up when the door panel is deformed according to the side-impact crash.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door outside handle that can absorb deformation of a hinge portion and a handle lever by dividing into two areas a handle base to which the hinge portion of a handle grip and the handle lever are coupled such that the hinge portion is broken away from one of the two areas of the handle base when a door panel is deformed as a result of the crash.

In one aspect, various aspects of the present invention are directed to providing a door outside handle according to an exemplary embodiment of the present invention including a first base to which a handle lever connected with a handle grip is coupled; a second base which is coupled with a hinge portion of the handle grip and formed to be separated from the first base, and performs pivotal movement toward the inside of a door with respect to the first base when a crash occurs; and a connection member connecting the first base and the second base together and facilitating the pivotal movement of the second base.

In an exemplary embodiment, the first base is formed in a connection area at which the first base is connected to the second base by the connection member and includes a guide member for guiding an initial position of the second base.

In another exemplary embodiment, the connection member forms a rotational axis for the pivotal movement of the second base and includes a pin piercing through both a first connection hole provided in the first base and a second connection hole provided in the second base to connect the first base and the second base; and a return spring for providing elastic force to the second base, installed around the pin in a shape of a coil.

Furthermore, the first connection hole is formed in a slot-hole type having a length enabling movement of the pin.

This return spring is installed to provide the second base with elastic force directing toward the handle grip.

Furthermore, the second base is separated selectively from the hinge portion as it performs the pivotal movement with respect to the first base.

The present invention has an advantage effect that since the handle base to which the hinge portion of the handle grip and the handle lever are coupled is divided into two areas such that the hinge portion is broken away from one of the two areas of the handle base when the door panel is deformed as a result of crash, deformation of the hinge portion and the handle lever can be absorbed.

Accordingly, by a structure in which the hinge portion is separated from the handle base, the present invention has advantageous effects of absorbing impact during deformation of the door panel according to a side-impact crash and consequently preventing a phenomenon that the handle grip is lifted up.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
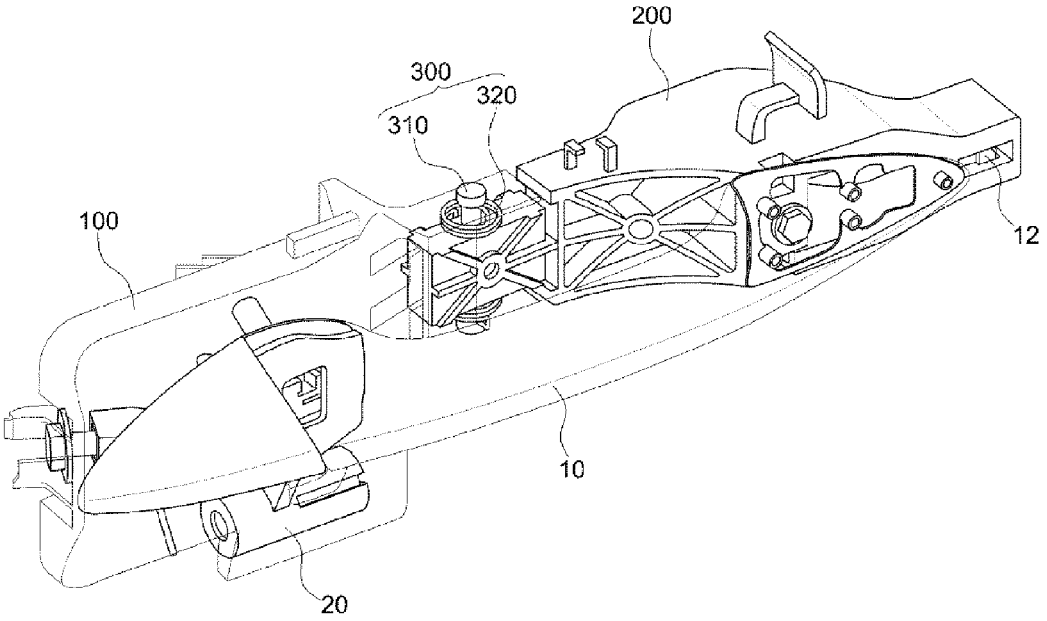
FIG. 1 is a view showing a structure of a door outside handle according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will now be described in detail with reference to the accompanying drawings.

Advantages and features of the present invention and methods for achieving them will be clearly understood from exemplary embodiments described in detail below with reference to the accompanying drawings.

However, the present invention is not limited to the exemplary embodiments described below, but can be implemented in various ways. The exemplary embodiments are provided to complete the disclosure of the present invention and to completely notify the scope of the present invention to those skilled in the art. Therefore, the present invention is defined only by the scope of the claims.

In addition, in the following description, detailed explanation of known related arts and the like may be omitted to avoid unnecessarily obscuring the subject matter of the present invention.

FIG. 1 is a view showing a structure of a door outside handle according to an exemplary embodiment of the present invention.

As shown in FIG. 1, the door outside handle according to an exemplary embodiment of the present invention includes a first base 100, a second base 200 and a connection member 300.

First, the first base 100 is coupled with a first side of a handle grip 10 to be pulled out and it is also coupled with a handle lever 20 connected with the handle grip 10 at the inside of a door.

That is, when a first side of the handle grip 10 is pulled out, an engaging portion of the handle grip 10 pulls out the handle lever 20 and hence the handle lever 20 rotates and a same time a latch is released while a cable connected to the handle lever 20 is pulled out and in turn the door is opened, wherein the first base 100 is mounted inside the door to be coupled with the handle grip 10 being pulled out and fixes and supports the location of the handle lever 20, wherein the handle lever 20 rotates as the handle grip 10 is pulled out.

The second base 200 is coupled with a second side of the handle grip 10, that is, a hinge portion 12 mounted at the handle grip 10, around which the handle grip 10 rotates, and it is formed separately from the first base 100.

This second base 200 is connected to the separated first base 100 by the connection member 300 and it is formed to perform pivotal movement with respect to the first base 100 toward the inside of the door in the event of a side-impact crash.

In other words, the second base 200 is connected with the first base 100 by the connection member 300, wherein it forms a conventional base having a predetermined length together with the first base 100, wherein it can be broken away from second side of the handle grip 10 and perform pivotal movement toward the inside of the door when deformation of a door panel occurs according to the side-impact crash so that it is possible to prevent the phenomenon that the handle grip 10 of the door panel is lifted up.

The conventional base is provided to have a length and fixedly coupled to both a first side and a second side of the handle grip 10. In the instant case, it is not possible to absorb impact transmitted to the handle lever 20 and the hinge portion 12 when deformation of the door panel occurs according to the crash, with the result that the handle grip 10 may be projected from an outside of the door.

Therefore, in the present exemplary embodiment of the present invention, a base to which the hinge portion 12 of the handle grip 10 and the handle lever 20 are coupled is divided into two areas, i.e., a first base 100 and a second base 200, so that when the deformation of the door panel occurs according to a side-impact crash, the hinge portion 12 can perform pivotal movement toward the inside of the door to absorb deformation of the door panel and at the same time it can be broken away from the second base 200, thereby preventing the phenomenon that the handle grip 10 is lifted up.

Figure 2:
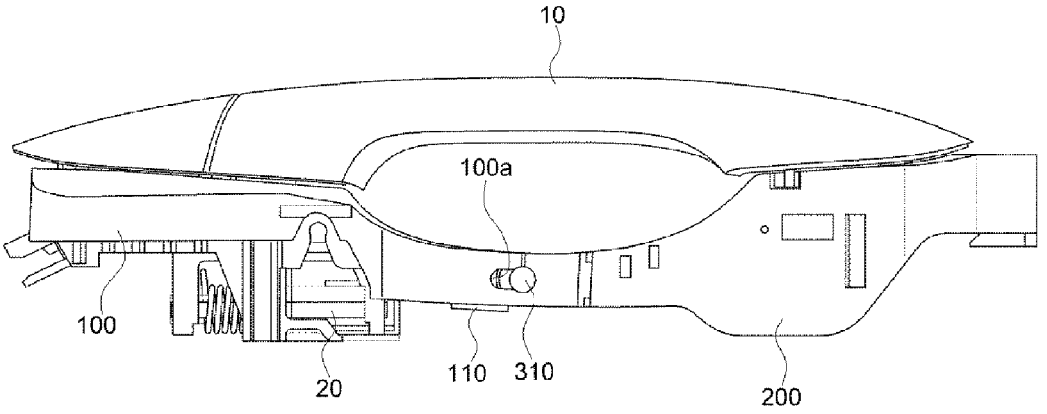
FIG. 2 is a view showing a door outside handle according to an exemplary embodiment of the present invention before crash.
Figure 3:
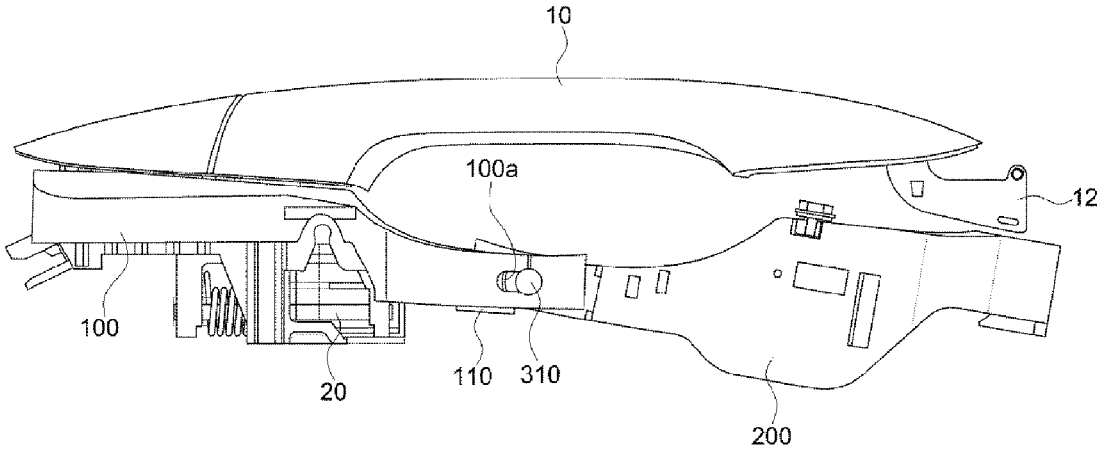
FIG. 3 is a view showing a door outside handle according to an exemplary embodiment of the present invention after crash.
Figure 4:
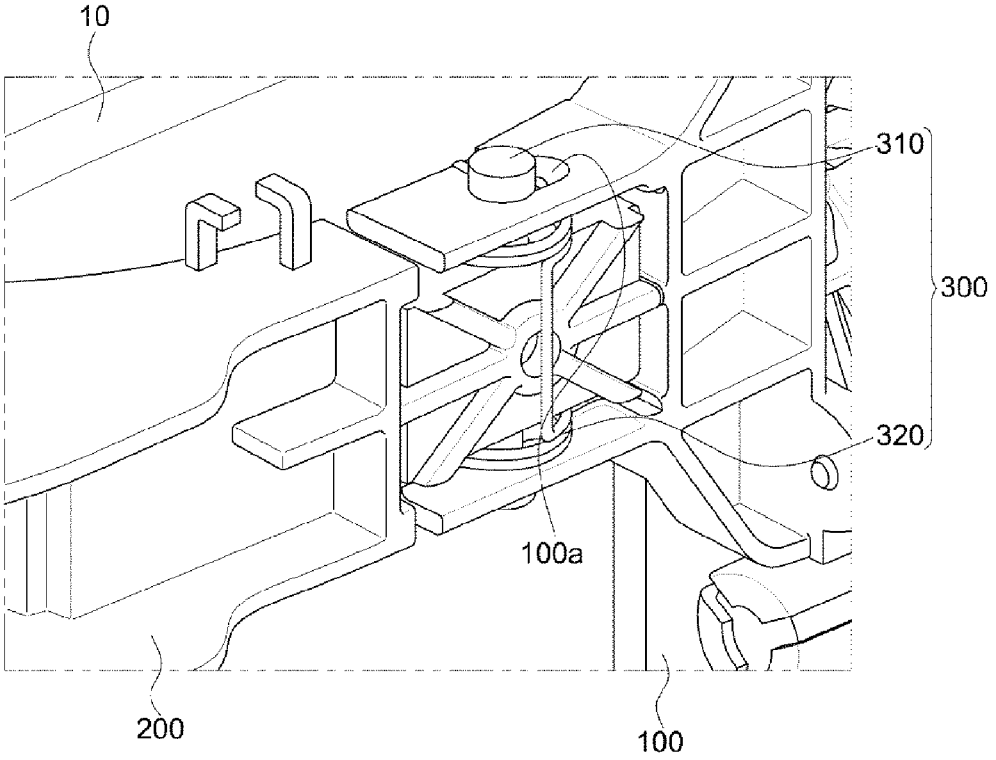
FIG. 4 is a view showing a connection member of a door outside handle according to an exemplary embodiment of the present invention.

FIG. 2 is a view showing a door outside handle according to an exemplary embodiment of the present invention before crash, FIG. 3 is a view showing a door outside handle according to an exemplary embodiment of the present invention after crash, and FIG. 4 is a view showing a connection member of a door outside handle according to an exemplary embodiment of the present invention.

As shown in FIG. 2, the door outside handle according to the exemplary embodiment of the present invention includes the first base 100, the second base 200 and the connection member 300 wherein the connection member 300 connects the first base 100 and the second base 200 and the second base 200 performs pivotal movement with respect to the connection member 300.

To this end, the connection member 300 is provided with a pin 310 and a return spring 320.

The pin 310 acts as a rotational axis for the pivotal movement of the second base 200 and connects the first base

100 and the second base 200 by being pierced through a first connection hole 100*a* provided in the first base 100 and the second connection hole (not shown) provided in the second base 200.

Now, as can be seen from FIG. 4, the first connection hole 100*a* is formed as a slot-shaped hole, to cope with a situation that the handle grip 10 moves longitudinally and is deformed in the event of the side-impact crash.

Further, the return spring 320 is installed in a coil shape, that is, a double coil spring shape around the pin 310 to impart elastic force to the second base 200.

In other words, as shown in FIG. 4, the return spring 320 is mounted in a connection area for connecting the first base 100 and the second base 200, wherein it can impart resilient to the second base 200 in a direction toward the handle grip 10 to allow the second base to retain its configuration in the normal state.

In the instant case, the first base 100 is provided with a guide member 110. This guide member 110 can guide an initial position of the second base 200 by being mounted to face an end portion of the second base 200 in the connection areas for connecting the first base 100 and the second base 200 such that the second base 200 cannot move forward in a direction toward the handle grip 10 by elastic force imparted thereto by the return spring 320.

On the other hand, as shown in FIG. 3, when a side-impact crash on the door occurs, the second base 200 rotates about the pin 310 toward the inside of the door so that impact can be absorbed through deformation of the second base 200 as stated above, preventing deformation of the hinge portion 12 and the handle lever 20.

In the instant case, when the handle grip 10 rotates twice or more at the second base 200 by the side-impact crash, the handle grip 10 is broken away from the second base 200, with the result that the impact exerted to a portion of the grip handle 10, which is coupled to the second base 200, can be prevented from being transmitted to a second portion of the grip handle 10, which is coupled to the second base 200, preventing the handle grip 10 from protruding from an outside of the door.

The present invention has an advantage effect that since the handle base to which the hinge portion of the handle grip and the handle lever are coupled is divided into two areas such that the hinge portion is broken away from one of the two areas of the handle base when the door panel is deformed as a result of crash, deformation of the hinge portion and the handle lever can be absorbed.

Accordingly, by virtue of a structure in which the hinge portion is separated from the handle base, the present invention has advantageous effects of absorbing impact during deformation of the door panel according to a side-impact crash and consequently preventing a phenomenon that the handle grip is lifted up.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door outside handle apparatus comprising:

a first base to which a handle lever connected with a first side of a handle grip is coupled;

a second base which is coupled with a hinge portion mounted at a second side of the handle grip and separately formed from the first base, and is pivotally movable toward an inside of a door with respect to the first base when a crash occurs; and a connection member pivotally connecting the first base and the second base together and facilitating pivotal movement of the second base with respect to the first base when the crash occurs, wherein a first side of the first base is coupled with the first side of the handle grip, a first side of the second base is coupled with the hinge portion, and the connection member pivotally connects a second side of the first base and a second side of the second base, such that the second base is separated from the hinge portion mounted at the second side of the handle grip when the second base pivots with respect to the second side of the first base when the crash occurs.

2. The door outside handle apparatus of claim 1, wherein the first base is formed in a connection area at which the first base is connected to the second base by the connection member, and wherein the first base includes a guide member for guiding an initial position of the second base.

3. The door outside handle apparatus of claim 1, wherein the connection member forms a rotational axis for the pivotal movement of the second base and wherein the connection member includes:

a pin piercing through both a first connection hole provided in the first base and a second connection hole provided in the second base to connect the first base and the second base; and a return elastic member for providing elastic force to the second base, mounted around the pin in a shape of a coil.

4. The door outside handle apparatus of claim 3, wherein the first connection hole is a slot having a length to enable movement of the pin.

5. The door outside handle apparatus of claim 3, wherein the return elastic member is installed to provide the second base with elastic force in a direction toward the handle grip.

* * * * *